US006144751A

United States Patent [19]

Velandia

[11] Patent Number: 6,144,751

[45] Date of Patent: Nov. 7, 2000

[54] CONCENTRICALLY ALIGNED SPEAKER ENCLOSURE

[76] Inventor: Erich M. Velandia, 6821 N. Saint Andrews Dr., Miami, Fla. 33015

[21] Appl. No.: 09/028,302

[22] Filed: Feb. 24, 1998

[51] Int. Cl.[7] ..... H04R 25/00

[52] U.S. Cl. ..... 381/345; 381/349; 381/351; 181/153

[58] Field of Search ..... 381/338, 348, 381/349, 345, FOR 141, 351, 337, 386, FOR 151, FOR 165, 350; 181/156, 153, 159, 199, 196, 198, 155

[56] References Cited

U.S. PATENT DOCUMENTS 4,298,087 11/1981 Launay ..... 181/153
5,189,706 2/1993 Saeki ..... 181/159

FOREIGN PATENT DOCUMENTS 003214226 10/1983 Germany ..... 381/FOR 141

*Primary Examiner*—Huyen Le

*Attorney, Agent, or Firm*—Malin, Haley & DiMaggio, P.A.

[57] ABSTRACT

The latest advances in speaker driver design have resulted in high output drivers with superior low frequency response, power handling, and linear excursion than conventional drivers. These new drivers present further problems to enclosure design due to large port surface area and long port length requirements. The present invention wraps a port completely around an enclosure, maximizing port surface area and placing the consequently lengthy port in a more practical position. The port of the present invention converts a circular cross-section to an annular cross-section with constant cross-sectional surface area, thus integrating a large port into an enclosure without a large dimensional increase. In one embodiment, a bandpass configuration demonstrated a reduction in port air displacement and noise. Response deviations in the present invention due to flaws in construction and open pipe resonance can be alleviated through the use of plastics and filters, respectively. The present invention is practical for high power applications (greater than 1,000 watts per driver) which require high output and superior frequency response, such as professional sound reinforcement systems.

15 Claims, 22 Drawing Sheets

$0° \leq \theta < 90°$ $$x = \frac{r + x_0}{\cos(\theta)} - r - \sqrt{\frac{(r + x_0)^2}{\cos^2(\theta)} - \frac{2(r + x_0)r}{\cos(\theta)} + r^2 - \frac{x_0^{\ 2}}{\cos(\theta)}}$$

$\theta = 90°$ $$x = \frac{x_0^{\ 2}}{2(r + x_0)}$$

$90° < \theta \leq 180°$ $$x = \sqrt{\frac{\left(r + x_0 + r\cos(180° - \theta)\left(r + \frac{r + x_0}{\cos(180° - \theta)}\right) + x_0^{\ 2}\right.}{\cos(180° - \theta)}} - r - \frac{r + x_0}{\cos(180° - \theta)}$$

CONCENTRICALLY ALIGNED SPEAKER ENCLOSURE

STATEMENT REGARDING FEDERALLY SPONSORED RESEARCH OR DEVELOPMENT

Not applicable.

CROSS-REFERENCE TO RELATED APPLICATIONS

Not applicable.

BACKGROUND OF THE INVENTION

1. Field of the Invention

This invention relates to acoustic speaker enclosures, and more particularly to a ported speaker enclosure in which the port is cylindrically wrapped completely around the enclosure thus maximizing port surface area and placing the long port in a more practical location.

2. Description of Related Art

Summary of definitions used herein:

$B_1$ Product of magnetic flux density and wire length of coil (motor strength)

$f_B$ Helmholtz resonance of vented or bandpass enclosure $f_h$ −3 dB lowpass cutoff of bandpass enclosure $f_1$ −3 dB highpass cutoff of bandpass enclosure $f_3$ −3 dB highpass cutoff frequency of closed or vented enclosures $M_t$ Total moving mass of driver $P_a$ Port surface area $P_l$ Port length $P_d$ Port diameter $S_d$ Effective surface area of driver $V_{as}$ Volume of air having same acoustic compliance as the driver suspension $V_d$ Peak displacement volume of cone $V_f$ Front chamber volume $V_r$ Rear chamber volume $V_t$ Total volume of chamber(s)

In the 1950s, the isobarik enclosure, as shown in FIG. 1, was first introduced. The isobarik enclosure loads multiple low frequency drivers into a sealed enclosure to effectively double $M_t$ and $B_1$, while halving $V_{as}$. An isobarik enclosure has several advantages over a sealed enclosure, as shown in FIG. 2. For example, it requires half the $V_t$ (with $f_3$ held constant) or a lower $f_3$ (with $V_t$ held constant). In either case, the isobarik system has the disadvantage of being less efficient (−3 dB).

Isobarik loading may also be used with ported enclosures, as shown in FIG. 3. Isobarik loading in a ported enclosure takes advantage of the smaller $V_t$ and lower $f_3$ of an isobarik configuration, in addition to a lower $f_3$ (compared to sealed enclosures) associated with ported enclosures, as shown in FIG. 4. Isobarik loading in a ported enclosure results in a smaller enclosure with superior frequency response. As with the isobarik enclosure discussed herein above, efficiency is compromised.

In addition, isobarik loading in a ported enclosure results in a problem associated with the port length. For a ported enclosure, if $f_3$ is held constant and $V_t$ is reduced, then $P_l$ increases. However, an isobarik ported enclosure with half of $V_t$ will suffer an increase in $P_l$ ranging from two to three times that of a ported enclosure with the same $f_3$. Port lengths of this magnitude are impractical for conventional cylindrical ports as $P_l$ approaches the largest enclosure dimension (length, width, or height).

Recent advances in motor design, cone materials, and adhesives have resulted in drivers with more than double the $M_t$ and $B_1$ of conventional drivers. These new drivers effectively have a more massive cone and a stronger motor. Thus, their performance is similar to two conventional drivers in an isobarik configuration without the volume associated with the extra driver and joining chamber. Due to their small $V_t$ requirement, these drivers have unusually lengthy ports when used in ported enclosures. As with isobarik enclosures, efficiency is lower, but is compensated for by using high temperature materials and motor cooling techniques. Excursion capability is also increased, quadrupling the electrical and mechanical power handling of the driver. The net result is a speaker system with greater output and superior frequency response in a smaller enclosure. This new driver design is a trend arising from the demand for smaller, higher performance speaker systems.

Another recent advancement in motor technology has resulted in drivers with very high output capability. These drivers feature a more efficient motor system, better motor cooling, and greater excursion. Their electrical and mechanical power handling approaches one kilowatt RMS or four times that of many high performance drivers. These drivers can produce a wider range of frequencies at higher sound pressure levels when used in ported enclosures, making them ideal for professional sound reinforcement applications.

A quadrupling of electrical and mechanical power handling results in twice as much $V_d$. For example, a driver may be capable of displacing a whopping 100 cubic inches of air, or twice that of a conventional driver with the same $S_d$. To minimize non-linear port operation, $P_a$ must be doubled, increasing $P_d$ by a factor of approximately 1.4. An increase in $P_d$ of this magnitude will increase $P_l$ from two to four times if the $f_B$ and $V_t$ are held constant.

In summary, new technologies make it possible to produce low frequency speaker drivers with greater output (due to better power handling) and superior frequency response in a smaller enclosure. When used in ported enclosures, unusually long port lengths result that are four to twelve times longer given twice as much $B_1$, $M_t$, and $V_d$. Such lengthy ports are often several feet in length, exceeding the largest enclosure dimension and rendering them very impractical. Consequently, ported designs using advanced, high output drivers need a better porting method that maximizes $P_a$ while reducing the impracticality of a lengthy $P_l$.

Speaker system designers have already had to deal with fairly lengthy ports, even with conventional drivers, and have developed several modifications or alternatives to conventional cylindrical ports. A common solution is to flare (gradually widen) the port ends as shown in FIG. 5. A flare provides a smoother exit for the air as it escapes the port at high velocity. A flare in the port ends allows the designer to reduce $P_d$ by less than 40%. Reducing $P_d$ reduces $P_l$ but is not advisable since it also increases nonlinear port operation. Port flares are most often used to reduce port noise (caused by turbulence) of conventional cylindrical ports that already have an acceptable $P_d$.

Passive radiators, as illustrated in FIG. 6, are sometimes used as well since they replace the port entirely through the use of a drone mass (usually a speaker cone and suspension without the motor structure). The drone has limited displacement compared to a port, requiring a very large diameter drone that can become impractical when using high output drivers.

Ducts are perhaps the most common way to implement unusually long port lengths, as shown in FIG. 7. Given a width to height ratio of less than 9:1, the length of a ducted port may be calculated in the same manner as a cylindrical port with the same $P_a$. For an advanced, high output driver, the resulting duct would become a labyrinth as several feet of port length are shaped to the appropriate dimensions. Furthermore, designing a ducted enclosure is time consuming because any change in $P_a$ and $P_l$ requires that the labyrinth be redesigned. The construction of such an enclosure is surely a challenge.

There exists a need for a ported enclosure for high output loudspeakers that solve the hereinabove mentioned problems.

BRIEF SUMMARY OF THE INVENTION

The present invention provides an alternative porting method that effectively wraps a port completely around a speaker enclosure, as illustrated in FIG. 8. The configuration of the port is comprised of three concentric cylinders and a specially curved end piece or transfer assembly. The space between the two outer cylinders, which contains an annular column of air, comprises the longest portion of the port. The annular air column is connected to the third cylinder through the transfer assembly. Advantages of the present invention over conventional porting methods include large $P_a$ and unusually long $P_l$ while placing the port in a more practical position. In addition, dimensional increases and design time are minimized while maximizing port length.

Although the present invention is structurally very different from a conventional design, its operation is quite similar. There is a driver mounted in a volume of air (the chamber) and another volume of air that leads outside the enclosure (the port). Cylindrical shaped chambers have been regularly implemented by designers, the difference is in the port configuration. To design an enclosure of the present invention, a transfer function that: modifies existing design formulas by relating actual $P_l$ to effective $P_l$ is derived and utilized.

A conventional port is simply a column of air that has a uniform $P_a$ and $P_l$, as illustrated in FIG. 9. The displacement of this air mass in relation to $V_t$ characterizes $f_B$. Since $V_t$ and $f_B$ remain unchanged in the present invention (no change in the tuning of the design), it is necessary to look more closely at $P_a$ and $P_l$.

Current formulas calculate $P_l$ in terms of $V_t$, $f_B$, and $P_a$. If the present invention is described in terms of uniform $P_a$ and an overall $P_l$, as in a conventional cylindrical port, then current formulas may be used in the design of the invention. This is accomplished by dividing the port of the present invention into three sections: the innermost cylinder, the transfer assembly, and the outer two cylinders. If a uniform $P_a$ is maintained throughout the length of the instant port, then the sections will operate in series as one air mass.

The innermost cylinder can be analyzed as a conventional cylindrical port. Its effective $P_l$ can be calculated directly from current formulas, as known in the art.

The unique geometry of the next section, the transfer assembly, is based on maintaining constant cross-sectional area as a cross-section starting at the innermost cylinder and rotates around toward the outer two cylinders, as shown in FIGS. 10 and 11. With $P_a$ held constant, the effective $P_l$ is approximately the path length of a point halfway between the inner and outer transfer assembly walls. The annular column of air formed by the outer two cylinders has a slightly longer $P_l$ than a conventional cylindrical port with the same $P_a$ and effective $P_l$. This is due to a large increase in the ratio of wall surface area to $P_a$, increasing frictional losses. The same is true of the transfer assembly as the cross-section rotates from the innermost cylinder to the outer two cylinders. The added length in this case is approximated through a linear model. With all three sections described in terms of constant $P_a$ and effective $P_l$, a piece-wise linear model representing actual length versus effective port length may be derived. The resultant linear model represents the transfer function necessary to design a port configuration of the present invention.

Accordingly, it is an object of the present invention to convert a circular cross-section to an annular cross-section with constant cross-sectional surface area.

It is another object of the present invention to convert a circular cross-section to an annular cross-section with constant cross-sectional surface area where the cross-sectional conversion has a toroidal curvature.

It is a further object of the present invention to provide a concentrically aligned speaker enclosure that includes a conversion from a circular cross-section to an annular cross-section with constant cross-sectional surface area, where the cross-sectional surface area over a preselected length forms a Helmholtz resonator air mass, or acoustic port.

It is still a further object of the present invention to provide a concentrically aligned speaker enclosure that includes concentric cylinders having a constant annular cross-sectional area across the length of the cylinders forming a port.

In accordance with these and other objects which will become apparent hereinafter, the instant invention will now be described with particular reference to the accompanying drawings.

DETAILED DESCRIPTION OF THE INVENTION

Figure 8:
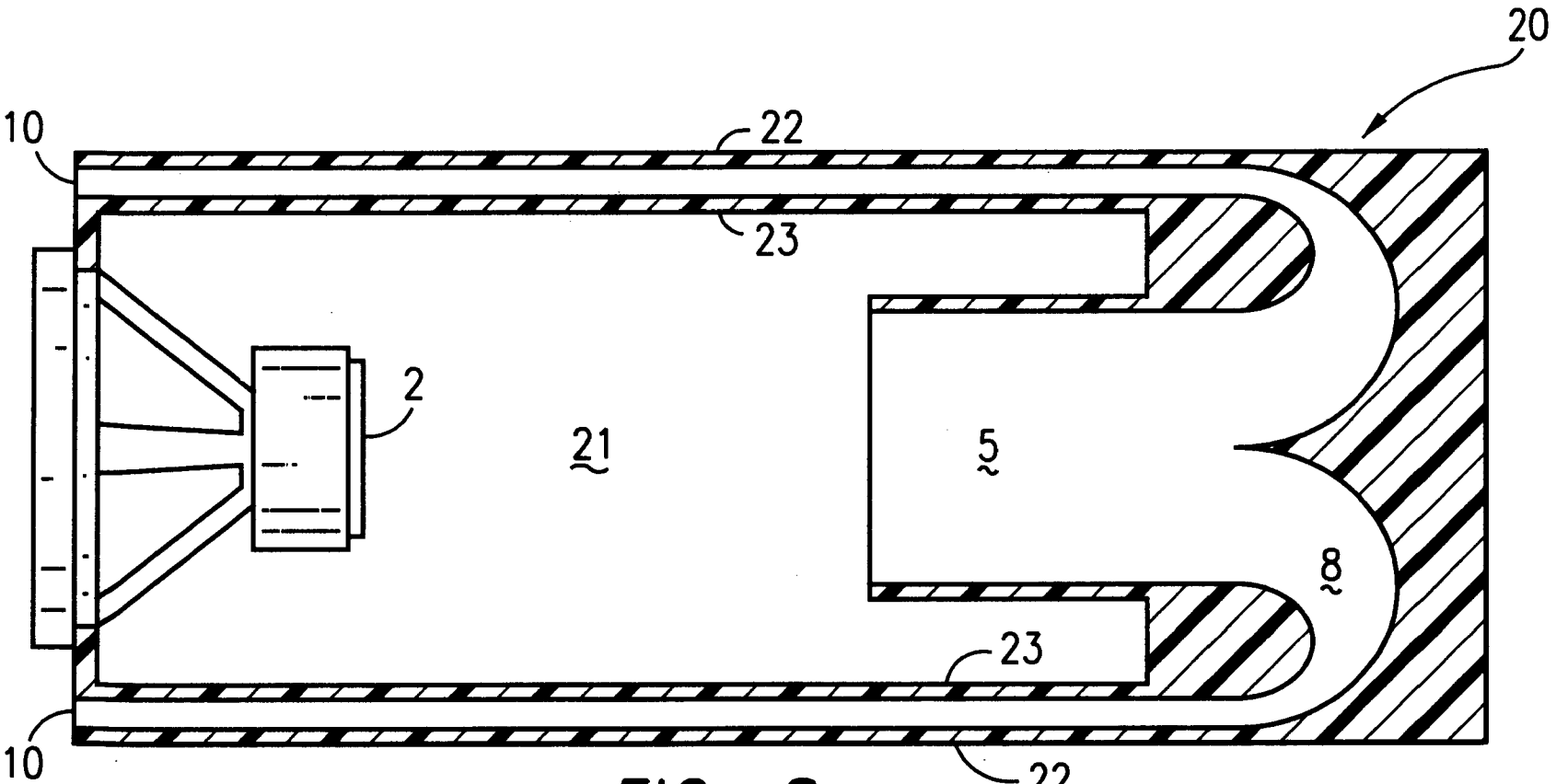
FIG. 8 is a side elevational view of one embodiment of the present invention with the enclosure in cross-section to illustrate the interior.

The present invention is fundamentally a porting technique that may be applied to any type of enclosure that uses ports. Referring to FIG. 8, the present invention includes driver 2 mounted to enclosure 20 at a preselected location within chamber 21. Enclosure 20 includes an acoustic port that is comprised of conventional cylindrical port 5, a transfer port assembly 8, and annular port assembly 10, as fully described hereinbelow. Annular port assembly 10 is essentially comprised of concentric cylinders, including outer cylinder 22 and inner cylinder 23. Cylindrical port 5 is a cylinder within inner cylinder 23. Transfer assembly 8 transforms the circular cross-section of cylinder 5 to the annular cross-section between cylinders 22 and 23. The port cross-sectional area remains constant as it is converted by transfer assembly 8, from circular within cylinder 5 to annular within annular port assembly 10. The best mode of the invention is believed to be cylindrical in shape. However, it is possible to construct the present invention in other geometric shapes.

Figure 9:
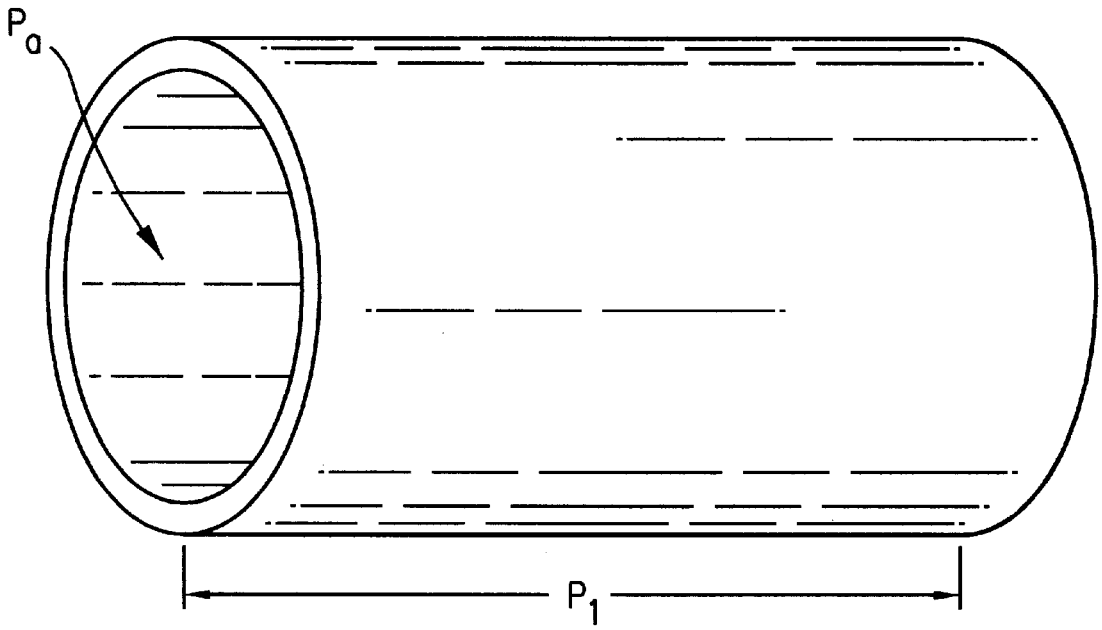
FIG. 9 is a perspective view of a column of air representative of the air within a conventional port.
Figure 12:
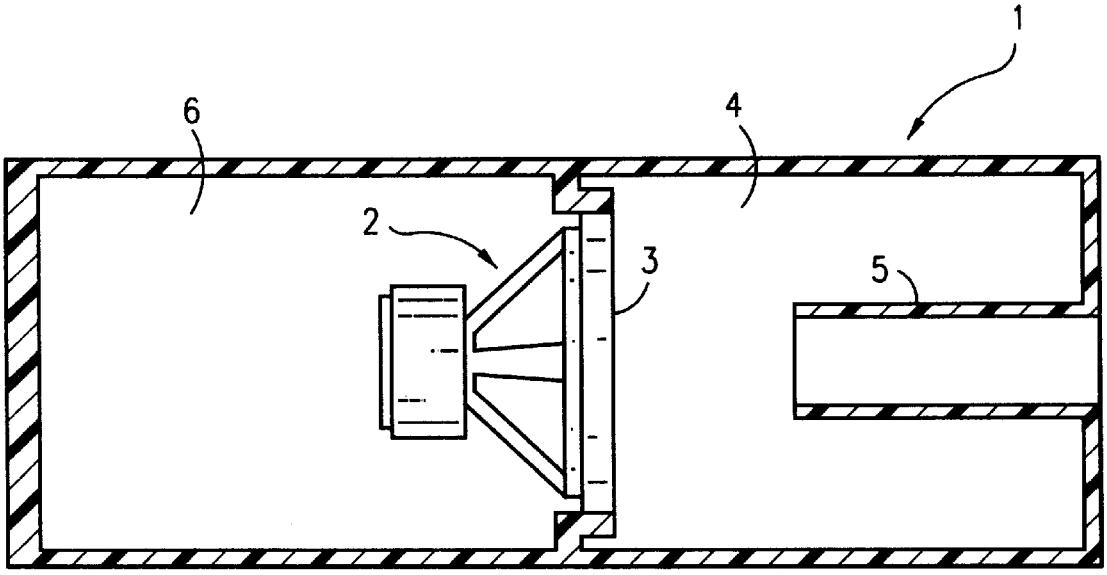
FIG. 12 PRIOR ART
FIG. 12 is a side elevational view of a prior art ported bandpass enclosure with a portion of the enclosure cut-away to illustrate the interior.

One embodiment of the present invention can be illustrated by application of the porting technique to a conventional bandpass enclosure 1, as shown in FIG. 12. The conventional bandpass enclosure 1 mounts the driver 2 between two chambers (front 4 and rear 6 relative to the speaker cone 3) with one or both chambers ported outside the enclosure (illustrated with chamber 4 ported by port 5). Referring to FIG. 9, bandpass enclosures often have lengthy $P_l$ since they require more $P_a$ than ported enclosures.

Figure 1:
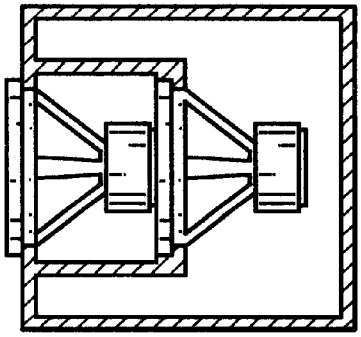
FIG. 1 PRIOR ART
FIG. 1 is a side elevational view of a prior art isobarik enclosure with the enclosure in cross-section to illustrate the interior.
Figure 2:
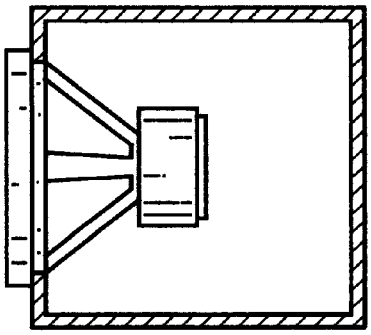
FIG. 2 PRIOR ART
FIG. 2 is a side elevational view of a prior art sealed speaker enclosure with the enclosure in cross-section to illustrate the interior.
Figure 3:
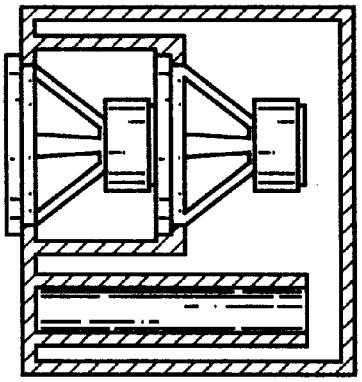
FIG. 3 PRIOR ART
FIG. 3 is a side elevational view of a prior art ported isobarik enclosure with the enclosure in cross-section to illustrate the interior.
Figure 4:
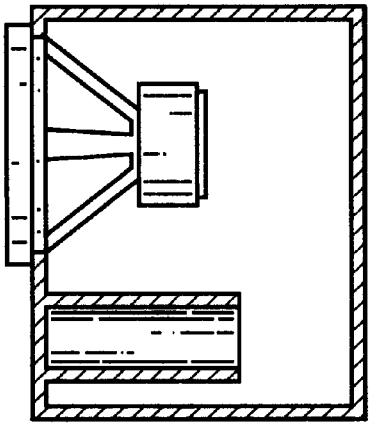
FIG. 4 PRIOR ART
FIG. 4 is a side elevational view of a prior art ported enclosure with the enclosure in cross-section to illustrate the interior.

The bandpass enclosure 1 is characterized by a bandpass frequency response and has several advantages over sealed or ported enclosures, as shown in FIGS. 2 and 4, respectively. For example, the bandpass enclosure 1 can have better frequency response (at the expense of efficiency) or better efficiency (at the expense of bandwidth). One disadvantage of a bandpass enclosure 1 is its sensitivity to minor flaws in construction. The lengthy $P_l$, large $P_a$, and high sensitivity to construction flaws make a bandpass enclosure 1 an ideal candidate for illustration of a prototype made in accordance with the present invention.

Figure 13:
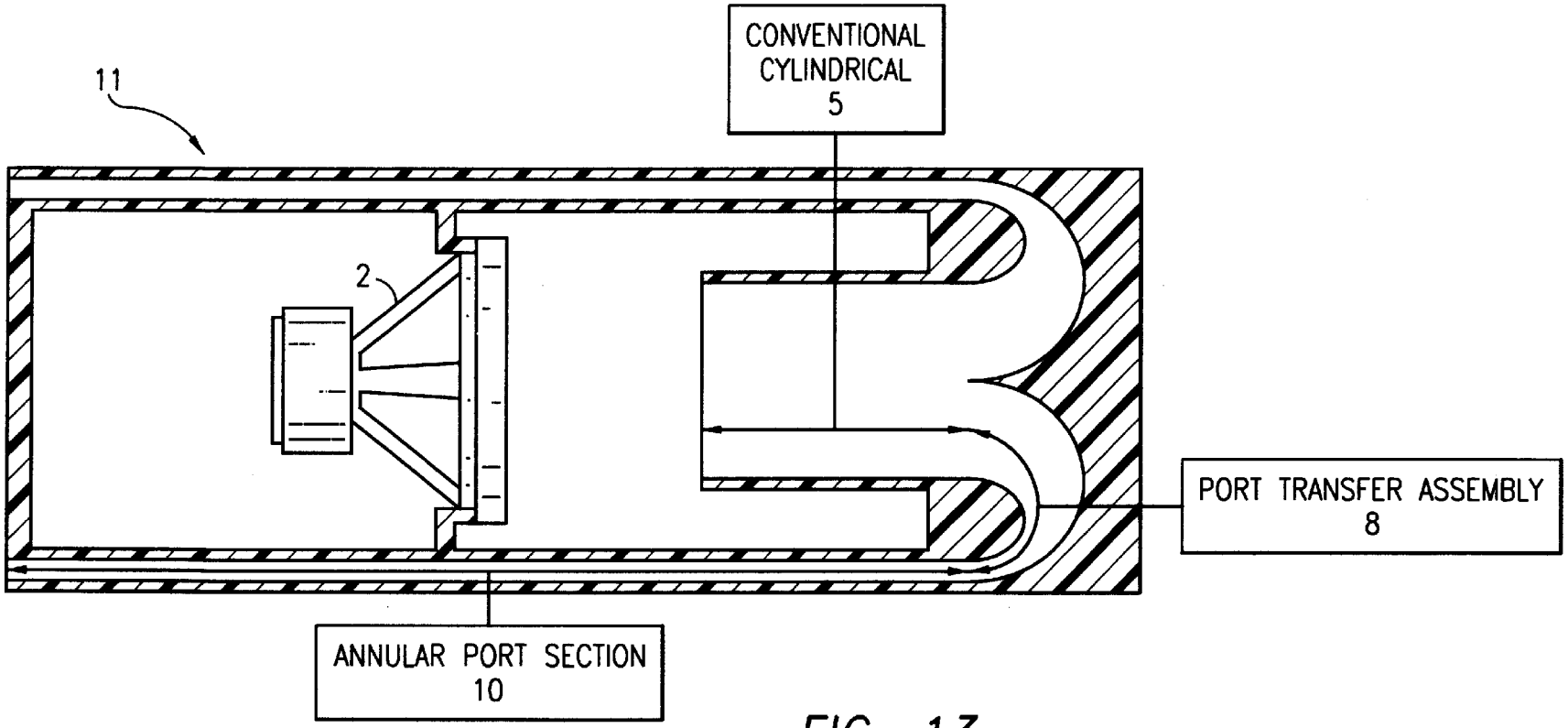
FIG. 13 is a side elevational view of one embodiment of the present invention with the enclosure in cross-section to illustrate the interior.

Referring to FIG. 13, the present invention is illustrated in a bandpass configuration 11. The present invention, which can be called a Concentrically Aligned Speaker Enclosure (CASE), can be designed with conventional speaker design techniques with the addition of a unique transfer function. The transfer function interprets conventional design specifications into the CASE specifications through a mathematical transformation. The central concept of the transformation is modeling the CASE port in terms of two conventional port characteristics: constant air surface area, and the ratio of wall surface area to air surface area along the entire port length.

Figure 14:
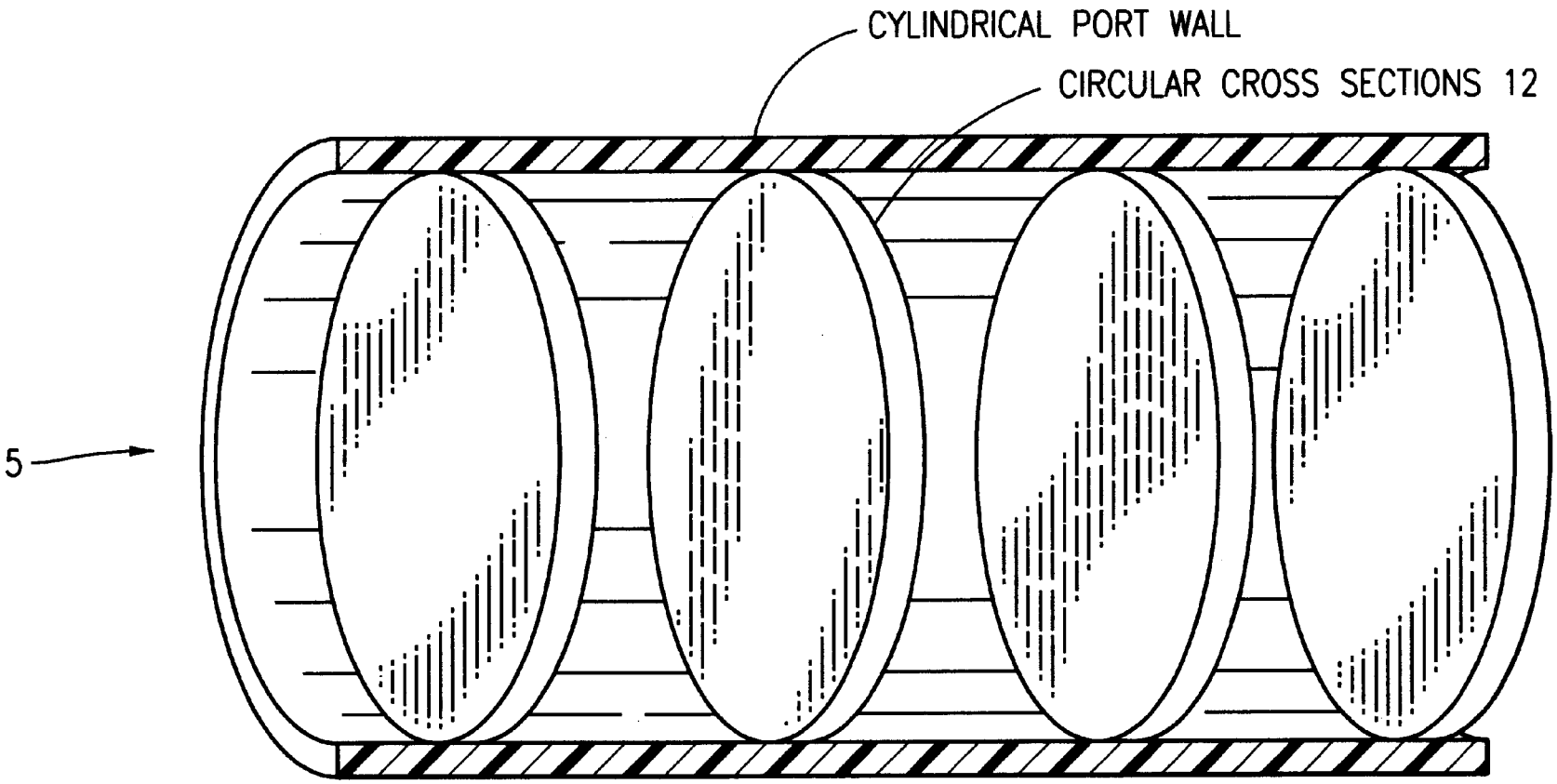
FIG. 14 is a perspective view of a conventional cylindrical port, partially cut-away, illustrating the constant cross-sectional area of the air contained therein.

Referring to FIG. 14, a conventional port 5 is a cylinder with a specific length and radius. Since the radius is constant along the entire port length, then it follows that the surface area 12 of the air in the port is also constant along the entire port length.

Referring to FIG. 13, the present invention provides the CASE port with a constant cross-sectional area along the entire port length by partitioning the port into three sections: the conventional cylindrical section 5, the transfer assembly 8, and the annular section 10.

The conventional cylindrical section 5 needs no special consideration since it is already a cylinder and is perfectly described by conventional port design techniques. The annular section 10 has a relatively simple geometry and the annular cross-section is already constant along the entire port length. On the other hand, the transfer assembly 8 is a special case of constant cross-sectional area along the entire port length since there is both a change in the geometry of the cross-section from circular to annular and a port curvature which wraps the port around the enclosure.

Figure 15:
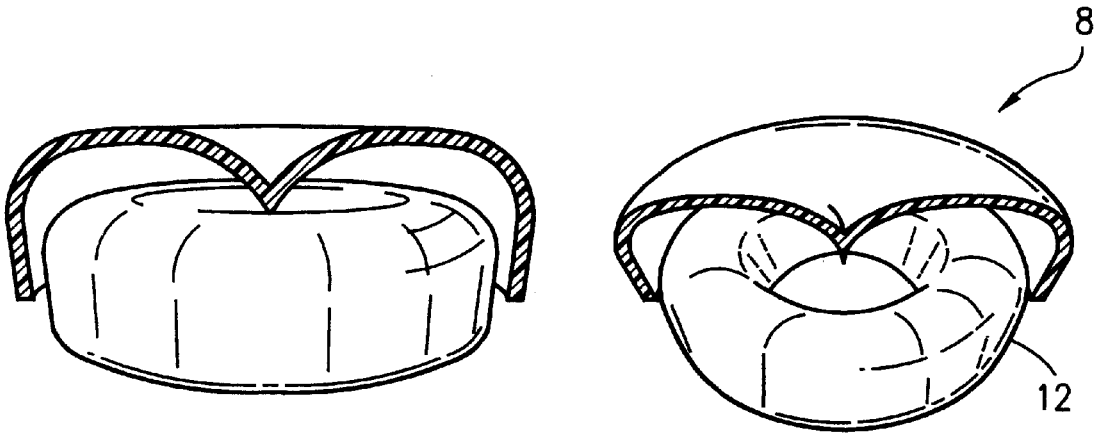
FIG. 15 is a perspective view of the transfer assembly illustrating the constant cross-sectional area at the entrance to the transfer assembly.

Referring to FIG. 15, the entrance to the transfer assembly 8 has a circular cross-section with the same radius as the conventional cylindrical port section 5. Thus, the entrance of the transfer assembly 8 has a circular cross-section with the same air surface area 12 as the conventional cylindrical port section, as shown in FIG. 14.

Figure 16:
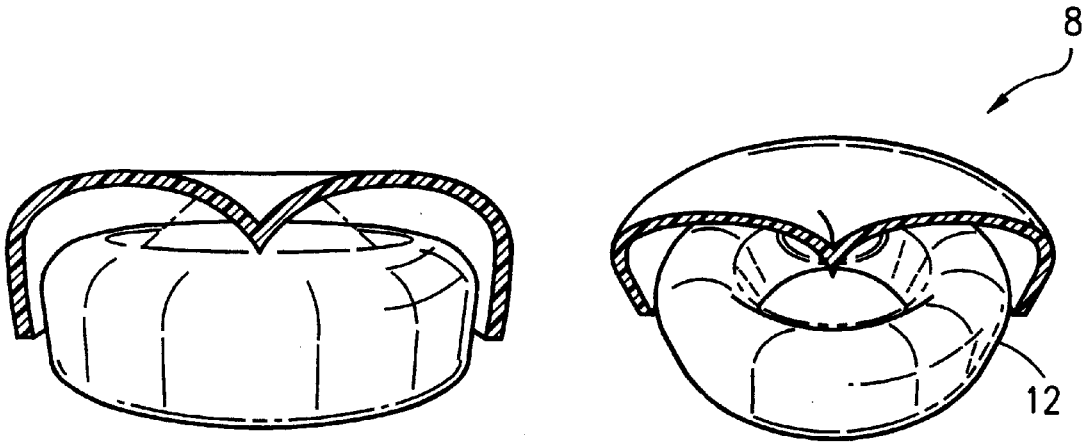
FIG. 16 is a perspective view of the transfer assembly illustrating the constant cross-sectional area conversion from circular to conical.

Referring to FIG. 16, the transfer assembly 8 then curves in such a way that the cross-section rotates and changes from circular to conical while maintaining a constant cross-sectional area 12.

Figure 17:
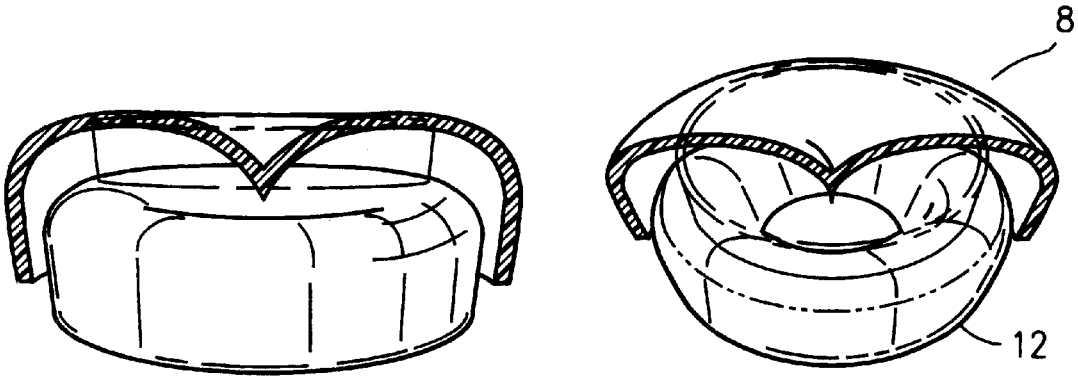
FIG. 17 is a perspective view of the transfer assembly illustrating the constant cross-sectional area conversion from conical to cylindrical.

Referring to FIG. 17, the cross-section continues to rotate and changes from conical to cylindrical while maintaining a constant cross-sectional area 12.

Figure 18:
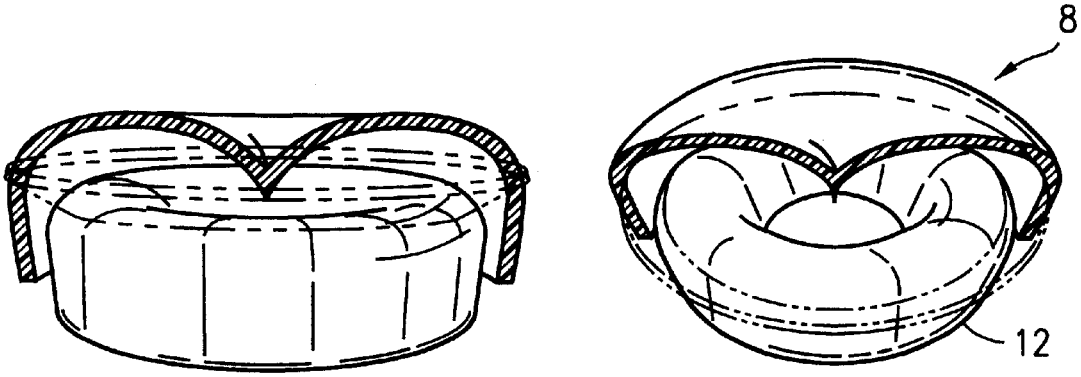
FIG. 18 is a perspective view of the transfer assembly illustrating the constant cross-sectional area conversion from cylindrical to conical.

Referring to FIG. 18, the cross-section rotates and changes from cylindrical to conical while maintaining constant cross-sectional area 12.

Figure 19:
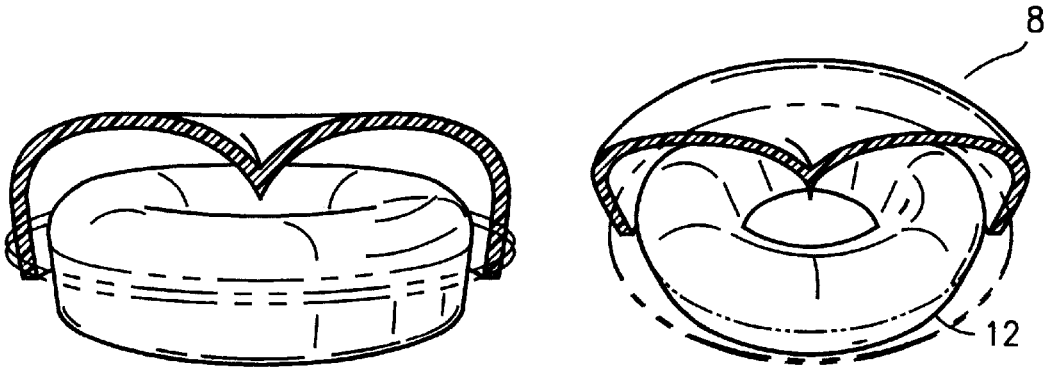
FIG. 19 is a perspective view of the transfer assembly illustrating the constant cross-sectional area conversion from conical to annular.

Referring to FIG. 19, finally, the cross-section rotates and changes from a conical cross-section to an annular cross-section while maintaining constant cross-sectional area 12.

Figure 10:
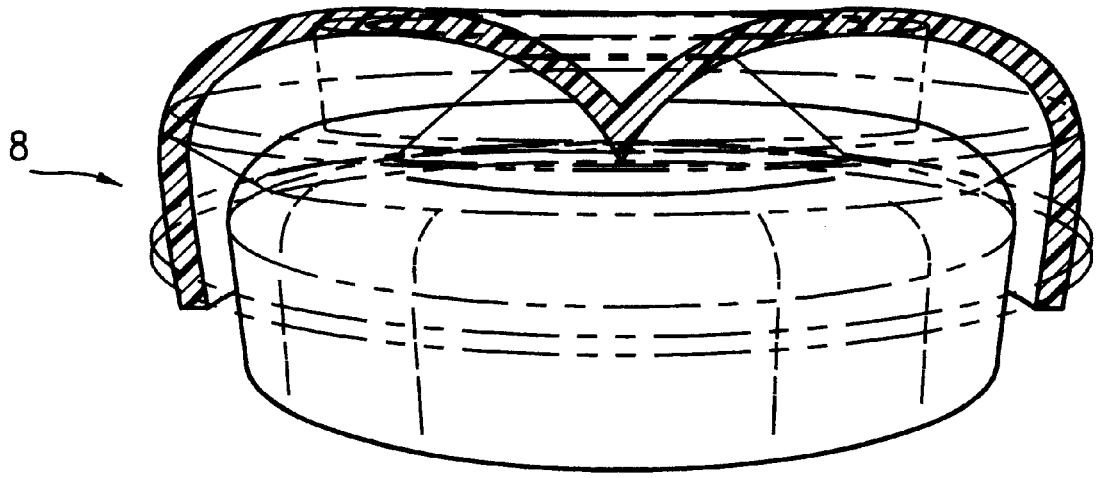
FIG. 10 is a side elevational view of one embodiment of the transfer assembly of present invention with a portion of the enclosure cut-away to illustrate the constant cross-sectional area of the port from circular to annular.
Figure 11:
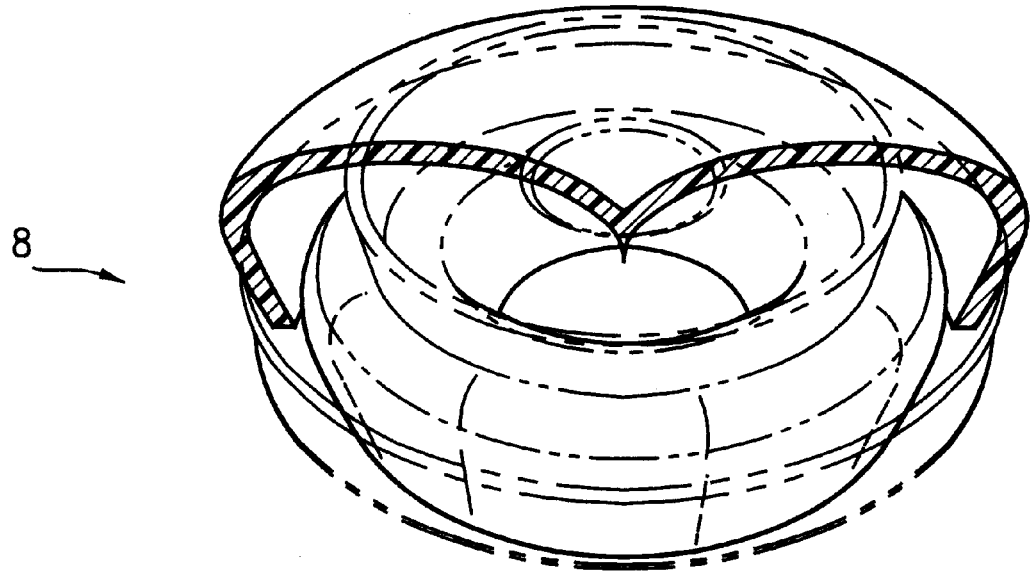
FIG. 11 is a top perspective view of one embodiment of the transfer assembly of present invention with a portion of the enclosure cut-away to illustrate the constant cross-sectional area of the port from circular to annular.

Thus, the cross-section was transformed from circular to annular while maintaining constant cross-sectional area 12 along the entire port length, as illustrated in FIGS. 10 and 11.

Figure 20:
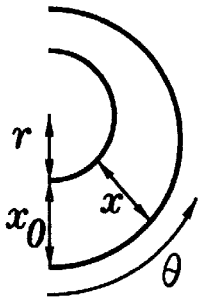
FIG. 20 is the mathematical relationship used to determine the distance between the torus and the rear curvature of the transfer assembly when the cross-sectional angle of rotation is between 0° and 90°.
Figure 21:
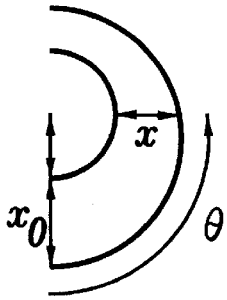
FIG. 21 is the mathematical relationship used to determine the distance between the torus and the rear curvature of the transfer assembly when the cross-sectional angle of rotation is 90°.
Figure 22:
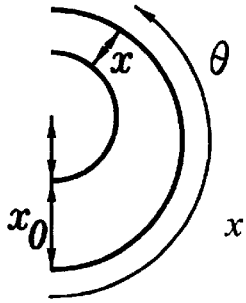
FIG. 22 is the mathematical relationship used to determine the distance between the torus and the rear curvature of the transfer assembly when the cross-sectional angle of rotation is between 90° and 180°.

Referring to FIGS. 20–22, the transformation of cross-sections from circular to annular can be precisely described by a series of mathematical equations. Three equations are used, each valid for a specific range of angles as a cross-section is changed from a circular to annular geometry over a 180 degree rotation. Each equation requires two constants, (port entrance radius and torus radius), and uses one variable, (cross-section angle of rotation), to calculate the distance "x" between the torus and the rear curvature of the transfer assembly. This distance then defines the rear curvature of the transfer assembly since the torus has a fixed radius.

The second conventional port characteristic modeled by the CASE port transfer function is the ratio of wall surface area to air surface area along the entire port length. This is necessary because the transfer assembly and annular section of the CASE port have more wall surface area than conventional ports given the same air surface area. This translates to an increase in frictional losses that change the resonant frequency of the port. Thus, the actual port length must increase to compensate for the frictional losses introduced by an increase in wall surface area. In practice, the actual increase in port length is less than 10%.

The CASE port design must compensate for frictional losses in those sections where there is an increase in wall surface area relative to a constant air surface area. Thus, the conventional cylindrical section needs no compensation while the annular and transfer assembly sections need compensation. The basis of this derivation is the comparison of circular and annular cross-sections. The result of this comparison is then associated with conventional port design and applied to both the annular port section and transfer assembly.

Figure 23:
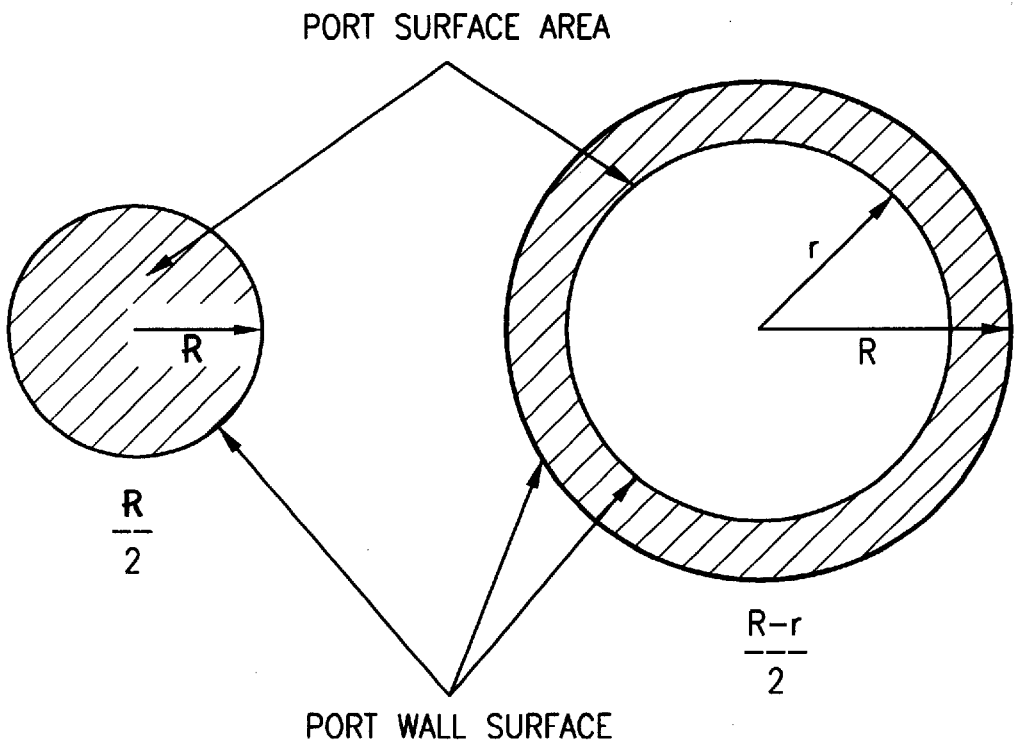
FIG. 23 is a mathematical representation of the air surface area to wall surface area for the annular section equated to the air surface area to wall surface area for a conventional port.
Figure 24:
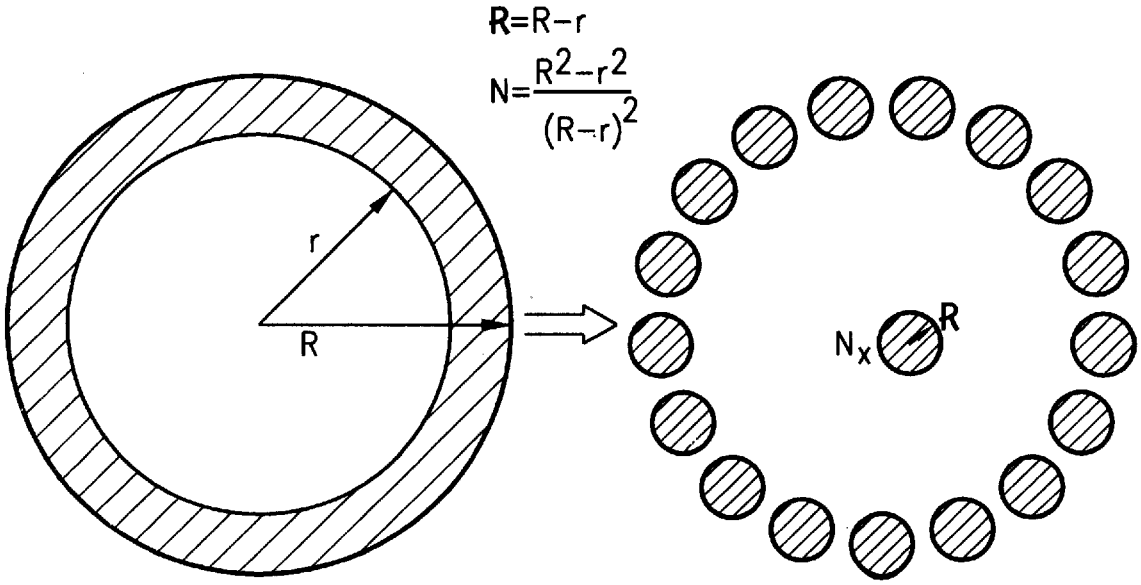
FIG. 24 is the surface area and air surface area to wall surface area characteristics of an annular cross-section represented by several small circular cross-sections.

Referring to FIG. 23, a mathematical representation of the air surface area to wall surface area for the annular section was equated to a mathematical representation of air surface area to wall surface area for a conventional port. This makes it possible to determine the radius of a small circular cross-section that has the same ratio of air surface area to wall surface area as an annular cross-section given an inner and outer radius. It is then possible to add several of these small circular cross-sections together in order to equal the area of the annular cross-section. Thus, the surface area and air surface area to wall surface area characteristics of an annular cross-section may be represented by several small circular cross-sections, as shown in FIG. 24.

The representation of an annular cross-section as many small circular cross-sections makes it possible to model the annular section of the CASE port as many small diameter cylindrical ports. The transfer assembly port length may be approximated in a similar manner by averaging the effective port length of the annular and cylindrical port sections. This representation of the CASE port is advantageous because existing conventional design techniques can calculate port lengths for enclosures with multiple cylindrical ports. Thus, the CASE port can be designed entirely with conventional design techniques in addition to the unique transfer function that relates conventional cylindrical port characteristics to the CASE port characteristics.

Figure 25:
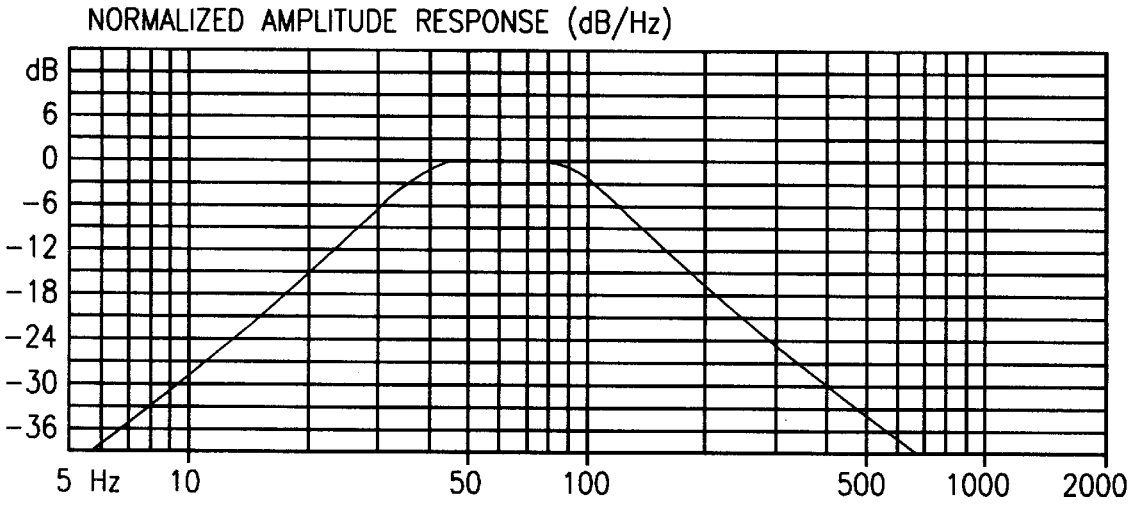
FIG. 25 is a computer modeled bandpass response curve.

The above transfer function was integrated into a spreadsheet programmed to calculate the dimensions of a bandpass CASE, as shown in FIG. 13. The spreadsheet calculations are a function of $f_B$, $V_f$, and $V_r$, which are calculated by a speaker CAD program (making it possible to model the design). A high performance driver was chosen (Atomic HPW 1094) and modeled in a bandpass enclosure, as illustrated in FIG. 25, for $V_r$=1.1 ft.$^3$, $V_f$=0.65 ft.$^3$, $f_B$=61.21 Hz., $f_1$=35.6 Hz., $f_h$=105.3 Hz. This design was then converted to a bandpass CASE by the spreadsheet program.

Based on computer model and spreadsheet calculations, a bandpass enclosure 1 and an equivalent bandpass CASE 11 were constructed. As shown in Table 1, the CASE porting method allowed for an unusually large $P_d$ and consequent $P_l$. It is interesting to note the relatively small increase in the overall dimensions of the enclosure despite the large increases in $P_l$ and $P_d$.

TABLE 1

| Enclosure Parameter | Bandpass Enclosure | Bandpass CASE |
|---|---|---|
| Effective $P_d$ | 4" | 7" |
| Effective $P_1$ | 11" | 37.5" |
| Enclosure Diameter | 13.25" | 16.5" |
| Enclosure Length | 33.5" | 36" |

Figure 26:
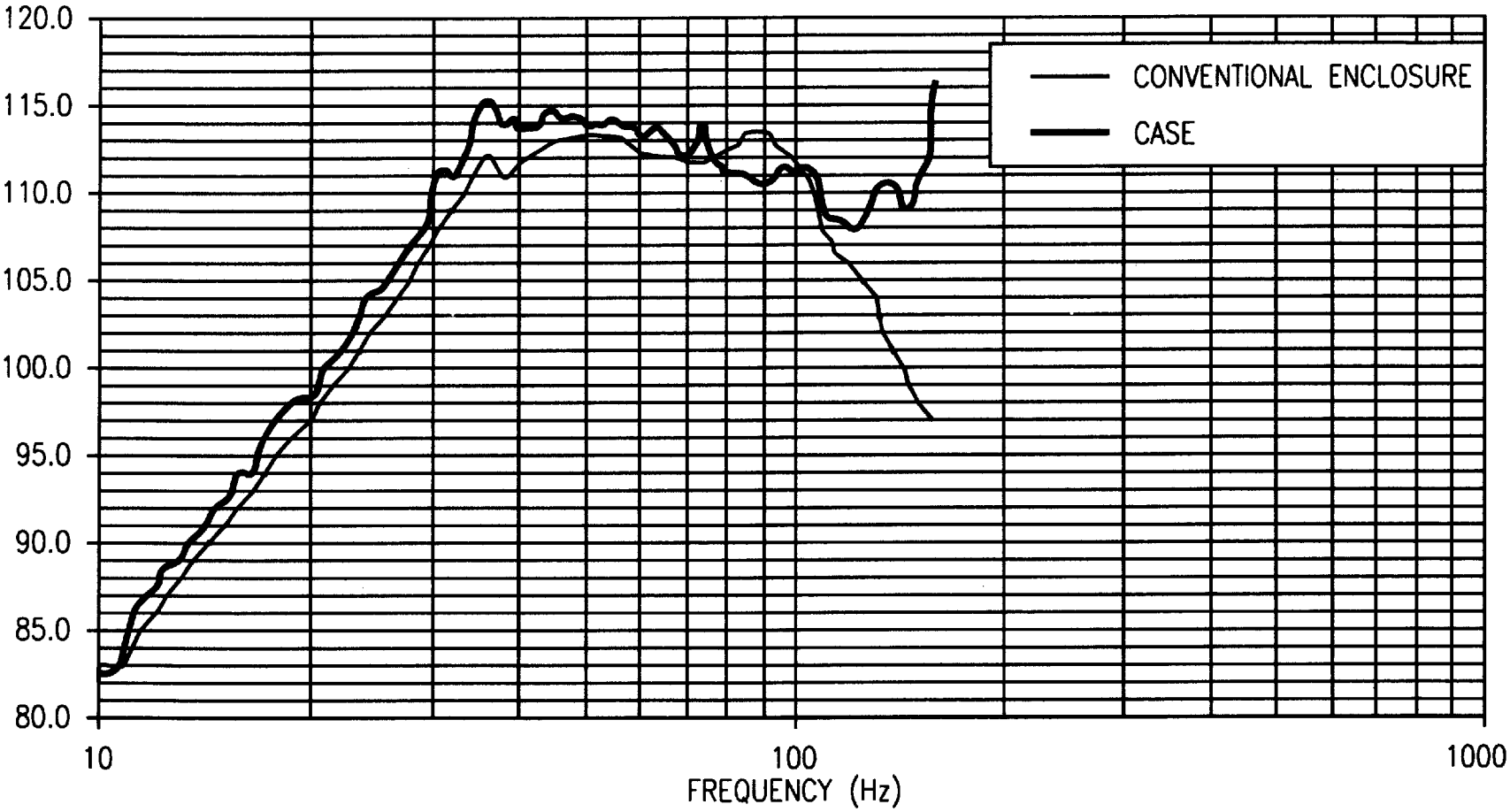
FIG. 26 is the near field response for a conventional bandpass enclosure and a bandpass CASE of the present invention.

An experiment was performed on the bandpass enclosure 1 and bandpass CASE 11 to determine the frequency response of each system. The near field response of the conventional enclosure (measured six inches from the port)

was determined using a sound level meter, signal generator, and power amplifier. The reverberant field response was then measured for both enclosures from the same speaker location and sound level meter location. The annular geometry of the bandpass CASE port made it difficult to measure its near field response relative to the bandpass enclosure. An alternative was to calculate the bandpass CASE near field response by adding the differences between the two reverberant field responses to the bandpass enclosure near field response. The results of the experiment are shown in FIG. 26 for a specific power level (approximately 10 W of power applied through a frequency sweep from 10 Hz. to 160 Hz.).

The experiment indicated that the bandpass enclosure response was very close to the predicted computer model response (FIG. 25). This confirms the accuracy of the bandpass enclosure as a benchmark in deriving the bandpass CASE near field response. The bandpass CASE response differed from the computer model in two respects: the slightly downward sloping passband response and the upward sloping response above the passband.

Further computer modeling indicated that the first deviation is due to a 5 Hz. to 10 Hz. decrease in $f_B$. This is probably due to a slight flaw in the construction of the two outer cylinders. A difference of less than ¼" in the diameter of either outer cylinder can produce the undesirable decrease $f_B$ and consequent downward sloping response. Therefore, the bandpass CASE 11 may be more sensitive to construction flaws than a bandpass enclosure 1.

Another experiment was performed to better determine the response beyond the passband. The results indicate that both enclosures had periodic peaks and valleys in their response curves. This is probably due to an open pipe resonance associated with $P_l$ in addition to harmonic resonant frequencies. This is confirmed by a prominent resonant frequency produced by the bandpass enclosure at approximately 600 Hz. That frequency coincides with the open pipe resonance of the port. At approximately 170 Hz., a similar prominent resonance occurs in the bandpass CASE which also coincides with its open pipe resonance. It is inevitable that some open pipe resonance will occur when enclosing a volume of air on four sides. This problem can be alleviated through the use of lowpass filters. There may be an alternative to filtering resonant frequencies by actually taking advantage of the added output they provide. By shifting the resonance closer to the passband (an increase in $P_l$) and with the help of additional filters to smooth the response, it may be possible for an enclosure to benefit from better efficiency or extended high frequency response.

The bandpass CASE port noticeably reduced port noise at high power levels. This is due to a $P_a$ that is triple that of the bandpass enclosure port, distributing the displaced volume of air over a larger area. The result is less displacement of the air mass inside the port. For example, it takes nine times as much power to displace the port air by the same distance in the bandpass CASE port than the bandpass enclosure port. This demonstrates the effectiveness of the CASE porting method when used with high output drivers.

As indicated by the response of the prototype bandpass CASE, it may be possible to extend high frequency response or increase efficiency by manipulating the port length and smoothing the response through filters.

Figure 5:
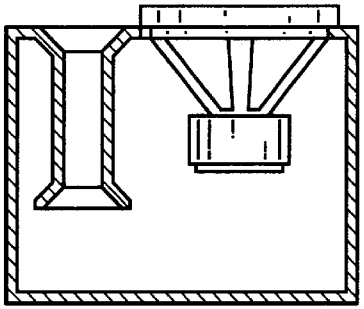
FIG. 5 PRIOR ART
FIG. 5 is that a side elevational view of a prior art ported enclosure having flared port ends, with the enclosure in cross-section to illustrate the interior.
Figure 6:
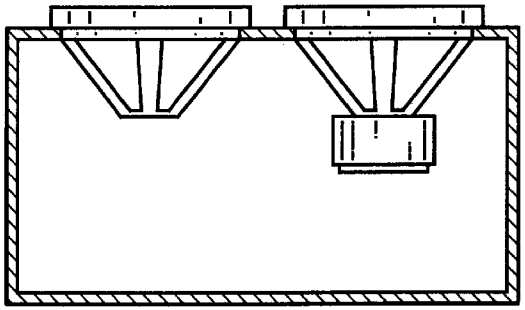
FIG. 6 PRIOR ART
FIG. 6 is a side elevational view of a prior art sealed enclosure having a passive radiator, with the enclosure in cross-section to illustrate the interior.
Figure 7:
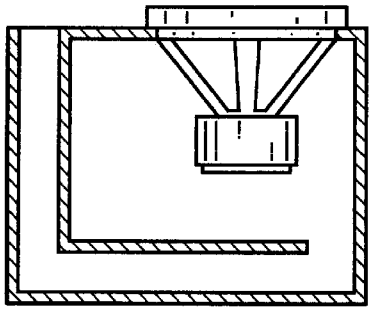
FIG. 7 PRIOR ART
FIG. 7 is a side elevational view of a prior art ported enclosure having an extended duct on the port to increase port length, with the enclosure in cross-section to illustrate the interior.

In addition, although the CASE greatly reduces port noise due to large $P_a$, there is still room for improvement through the use of flares, as in conventional designs, as shown in FIG. 5.

Figure 27:
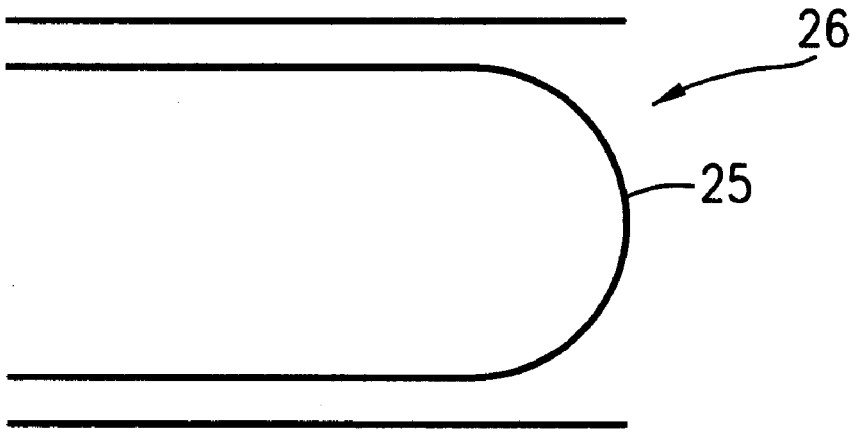
FIG. 27 is a side elevational view in cross-section illustrating an inward flared port.
Figure 28:
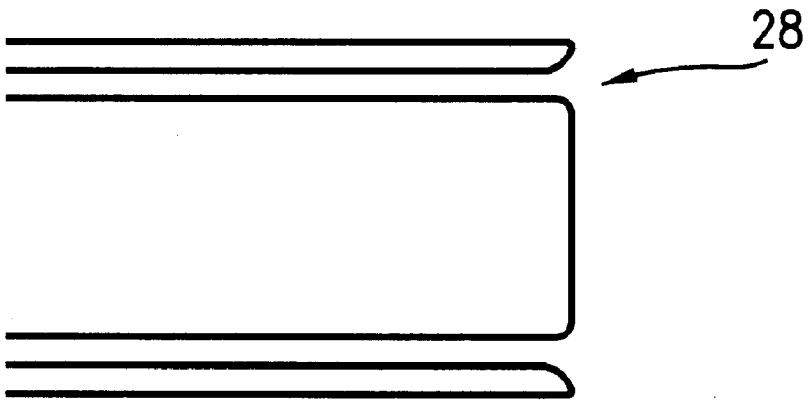
FIG. 28 is a side elevational view in cross-section illustrating a hybrid flared port.

Referring to FIGS. 27 and 28, while conventional ports are either linear or outward flared, the concentric geometry of the CASE port allows for inward 26 flared (FIG. 27) and hybrid 28 (FIG. 28) flared variations. The inward flare 26 maximizes port entrance or exit surface area and allows for less turbulent air flow into and out of the port. However, the flared portion of the port adds little effective port length and tends to elongate the actual length of the enclosure. It may be more practical in some cases to have a hybrid port entrance or exit since it allows for more compact enclosures. The hybrid flare 28 may not be practical for very high velocity air flow since it is preferable in that situation to maximize port exit surface area while minimizing the rate of change in port surface area.

Figure 29:
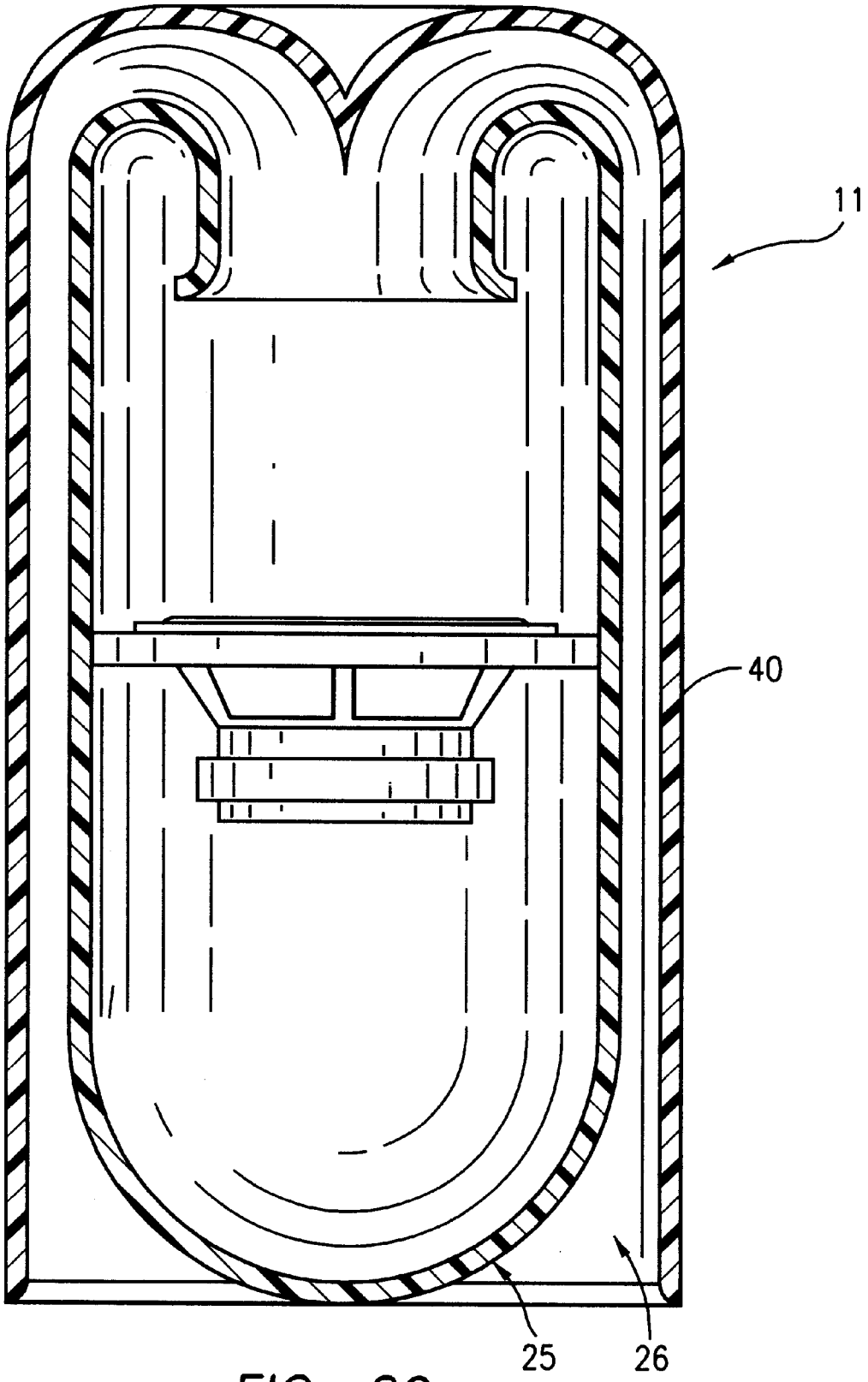
FIG. 29 is a side elevational view illustrating an inward flared port.
Figure 30:
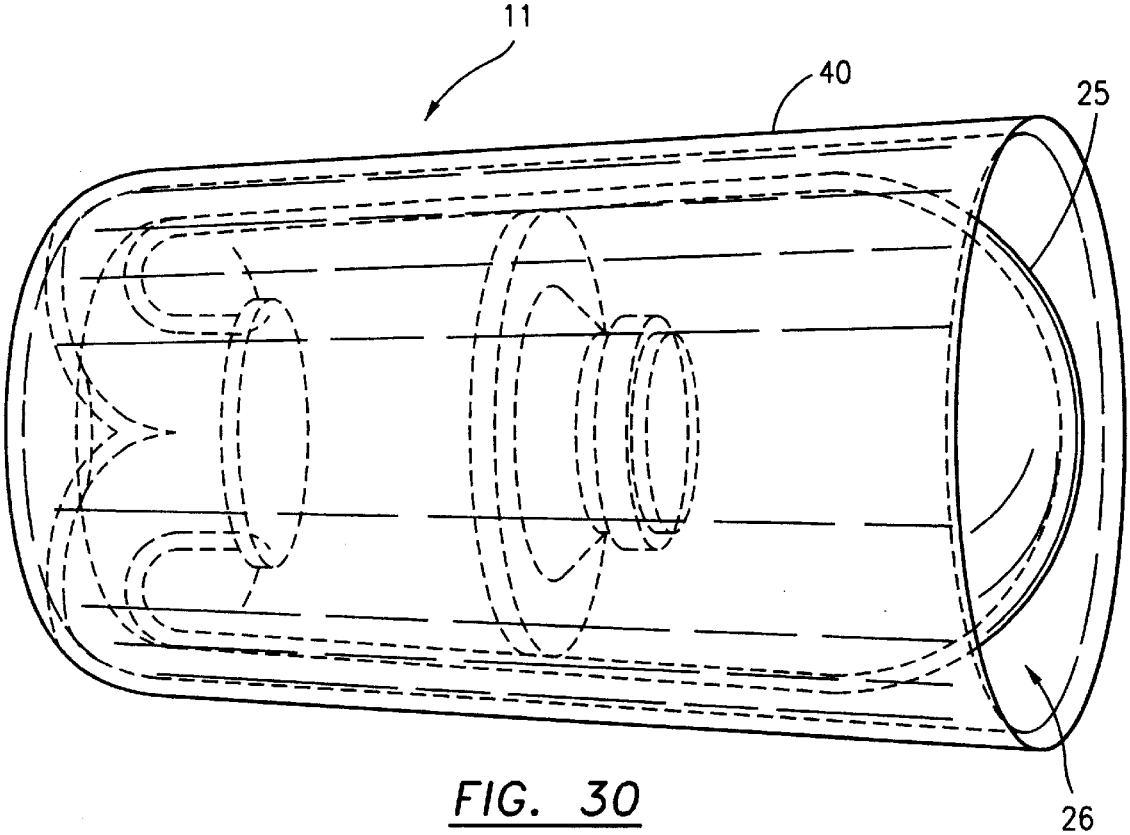
FIG. 30 is a perspective view illustrating an inward flared.

Referring to FIGS. 29 and 30, the annular geometry of the inward flared port 26 exit allows for the addition of a hemisphere 25 to the front of the CASE. The outer cylinder 40 is essentially extended, forming a huge flare which is almost the diameter of the entire enclosure 11. Since the CASE already reduces port air displacement, an inward flare 26 would provide added headroom for drivers with even greater output capability.

Figure 31:
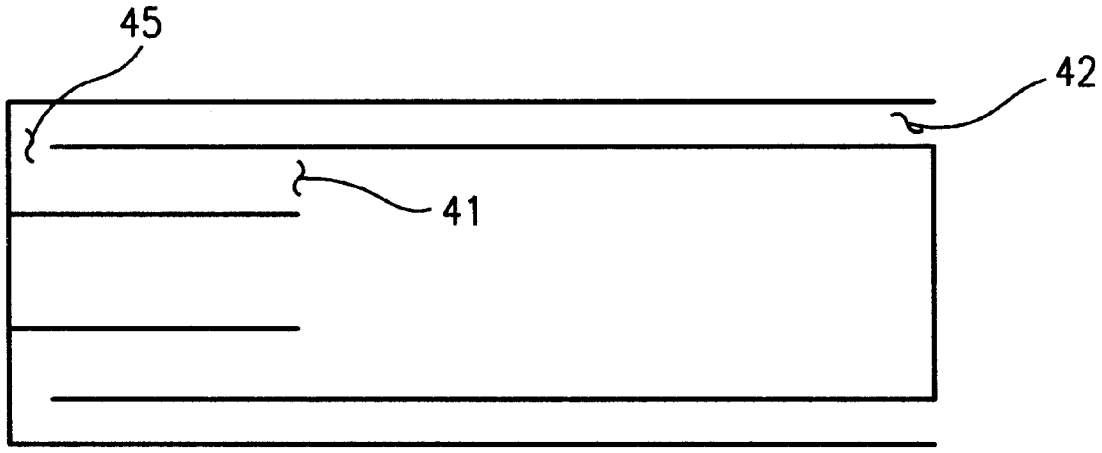
FIG. 31 is a side elevational view in cross-section illustrating an annular to annular port configuration.
Figure 32:
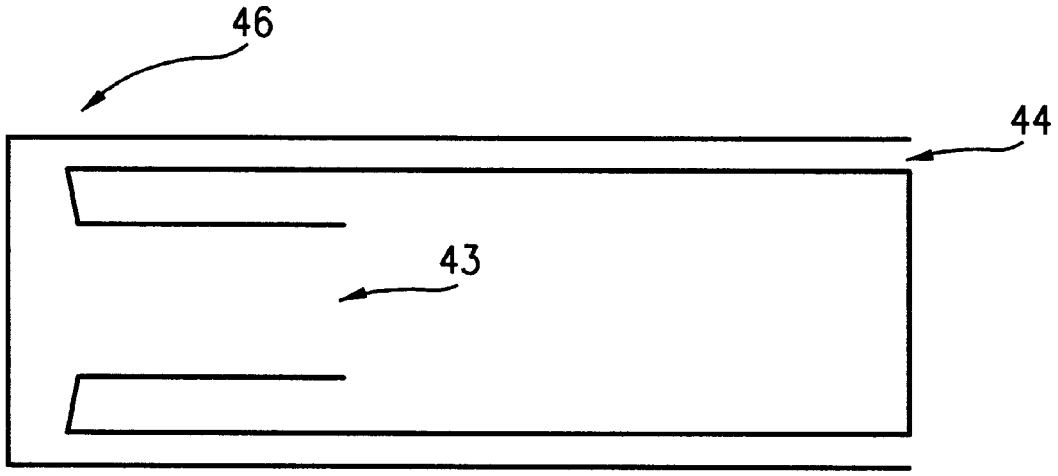
FIG. 32 is a side elevational view in cross-section illustrating a hybrid of a cylindrical and annular port configuration.
Figure 33:
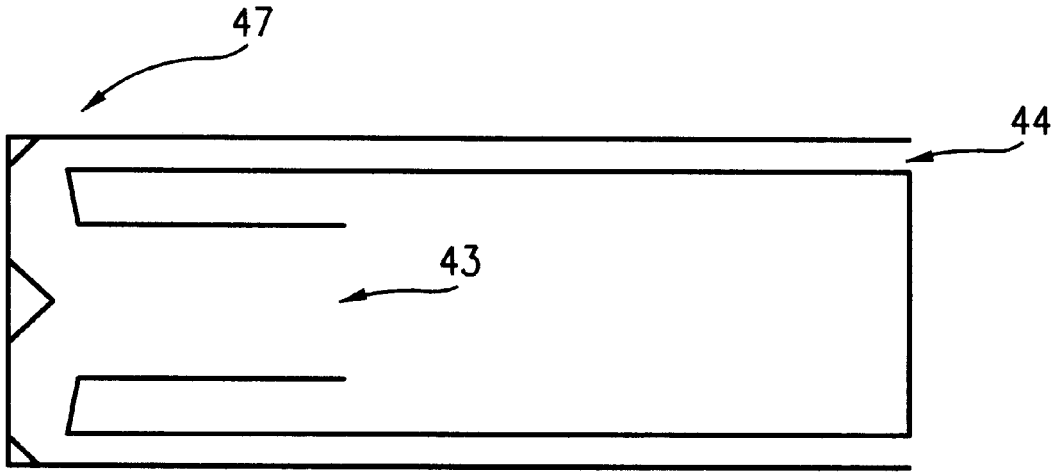
FIG. 33 is a side elevational view in cross-section illustrating a linear transition between a cylindrical port and an annular port.

Referring to FIGS. 31, 32, and 33, while conventional ports are entirely cylindrical, the CASE port may be entirely annular (FIG. 31) or a hybrid of both cylindrical and annular geometries (FIGS. 32 and 33).

An annular port has the advantage of maintaining an annular cross-sectional geometry, thus minimizing frictional losses due to a change in cross-sectional geometry. The annular port of FIG. 31 includes two annular sections 41 and 42, which are connected at transfer assembly 45. However, an annular port has a more abrupt change of port direction which decreases air flow.

The hybrid ports of FIGS. 32 and 33 maximizes air flow as the port wraps about the enclosure due to a minimum rate of change in port direction. The hybrid ports of FIGS. 32 and 33, have a cross-section that changes from circular 43 to annular 44. This introduces additional frictional losses that decrease air flow.

The transfer assembly changes both port direction and cross-sectional geometry. Ideally, this change is smooth and continuous with a curved transfer assembly 8 in order to maximize air flow, was shown in FIGS. 8 and 13. Alternately, as shown in FIG. 33, transfer assembly 47 is more linear to minimize the complexity of construction. This makes the construction of the transfer assembly more practical, especially if the CASE is being constructed by hand. However, making the transfer assembly less smooth and continuous impedes high velocity air flow within the port. FIG. 32 illustrates a transfer assembly 46 which is even more abrupt, but which can still transfer the port from cylindrical to annular in cross-section.

Figure 34:
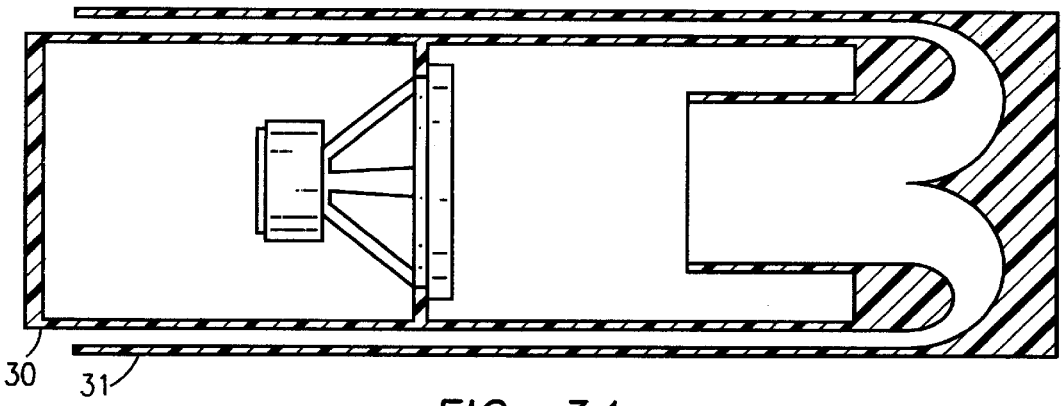
FIG. 34 is a side elevational view in cross-section illustrating an inner cylinder extending beyond the outer cylinder in an annular port.
Figure 35:
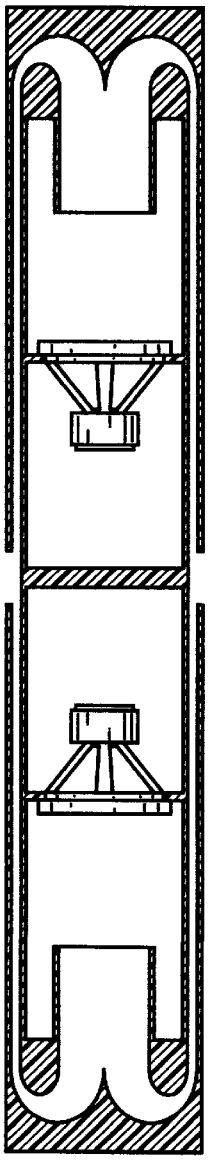
FIG. 35 is a side elevational view in cross-section illustrating the stacking ability of that shown in FIG. 34.

Referring to FIGS. 34 and 35, it is desirable that multiple speakers can be stacked on top of one another for sound reinforcement applications. Although the CASE port exits from the top or bottom of the enclosure, it is still possible to stack multiple CASEs on top of one another by extending the length of the inner cylinder 30 relative to the outer cylinder 31. This simplifies the placement of the CASE at the expense of shortening the effective port length. On the other hand, this configuration maximizes the use of space when using multiple CASEs, as shown in FIG. 35.

Even though the dimensions of the CASE prototype as described hereinabove, shown in FIG. 13, were not that much greater than the conventional enclosure, shown in FIG. 12, it is possible to reduce the dimensional increases through the choice of construction materials. The cylinders, transfer assembly, and hemispherical flare could be made out of a plastic material. If made out of plastic, the hemispherical flare would be hollow, making it part of the rear chamber volume. This would reduce the dimensional increases caused by the flare. Plastics can also make the construction of a CASE more uniform, reducing the chance of shifts in the frequency response.

Figure 36:
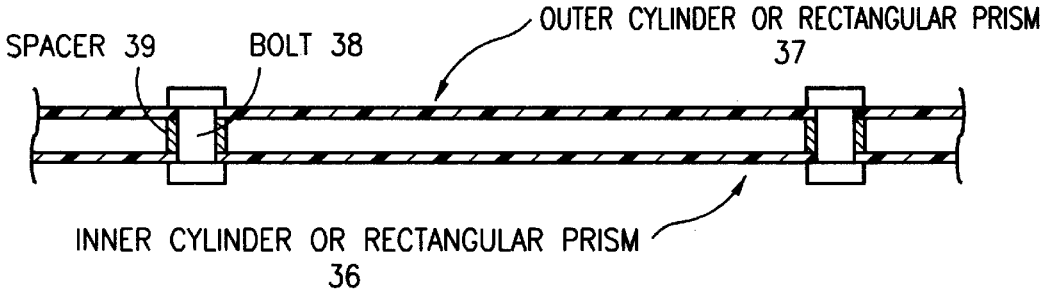
FIG. 36 is a side elevational view in cross-section illustrating one embodiment for attachment of the inner and outer cylinders of the annular port.
Figure 37:
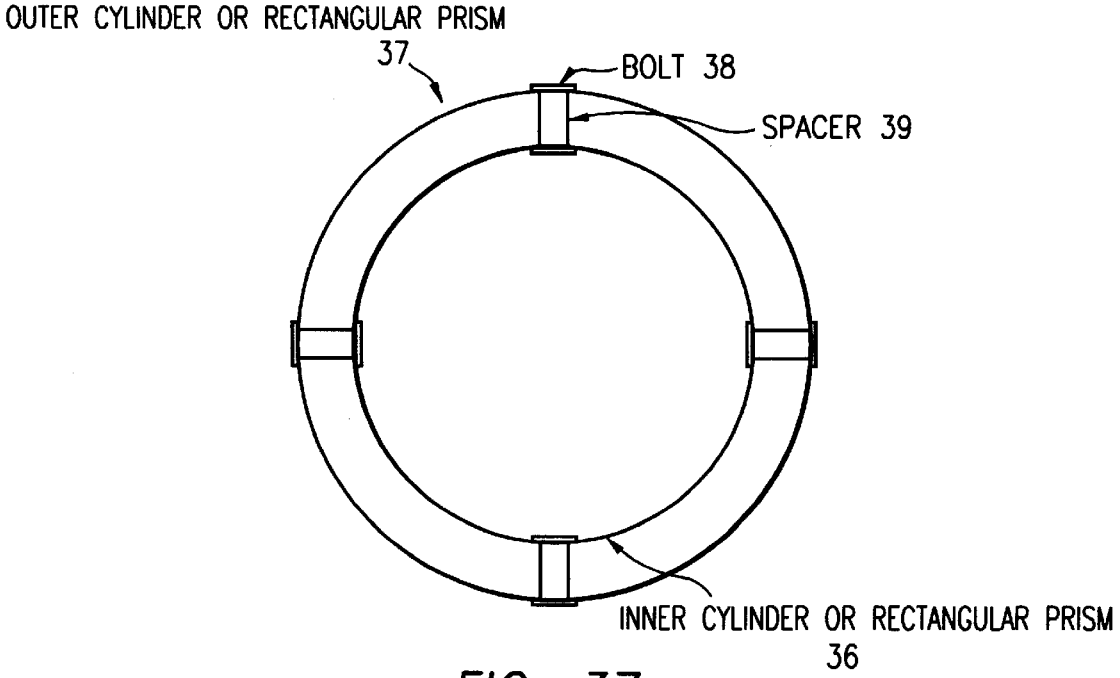
FIG. 37 is a front elevational view in cross-section of that shown in FIG. 36.

Referring to FIGS. 36 and 37, it is preferred that the CASE port have precise dimensions which should be maintained along the entire port length. Thus, it is very important to properly align the concentric cylinders, or rectangular prisms, of the CASE. The alignment must be robust enough to maintain the preselected shape of the CASE while operating under the extreme forces produced by very high power drivers. One possible method of construction connects the inner 36 and outer cylinder 37 or rectangular prisms with bolts 38 and cylindrical spacers 39. This method is advantageous due to its counteraction of both compression and extension forces.

In addition to the embodiments described hereinabove, the CASE port can provide several alternate embodiments that offer varying levels of performance and functionality. The performance variations include modifications to the cross-sectional geometry, port type, port entrance and exit type, and transfer assembly type. The functional feature variations include modularity when using multiple speaker enclosures, and include other methods for internal alignment of the enclosure.

As discussed hereinabove, the preferred embodiment of the CASE port is circular transferring to annular in cross-section. However, the CASE port can have a wide variety of possible cross-sectional geometries ranging from circular to rectangular. Thus, the CASE may be composed of a wide variety of concentric geometries ranging from concentric cylinders to concentric rectangular prisms. The circular to annular cross-sectional geometry has the advantage of maximizing air flow due to the minimization of wall surface area. On the other hand, a CASE with a rectangular or square cross-section minimizes the enclosure size and construction complexity.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A ported enclosure for an acoustic speaker, comprising:

a housing having an exterior and having at least one internal chamber, said housing including means for mounting at least one acoustic speaker at least partially within said housing at least one internal chamber;

a port connecting in fluid communication said housing at least one internal chamber with said exterior of said housing, said port constant, having a uniform cross-sectional area throughout and having a first member being substantially annular in cross-section, said first member being adjacent the exterior of said housing, said first member having an annular cross-sectional area;

said port including a second member being substantially circular in cross-section, said second member being adjacent said at least one internal chamber, said second member having a circular cross-sectional area;

said port including a third member between said first and said second members, said third member having a cross-sectional area and including means for transferring said second member circular cross-section area to said first member annular cross-section area, and said first member, said second member, and said third member each having substantially equal cross-sectional areas throughout their lengths.

2. The device of claim 1, wherein said second member is substantially cylindrical in shape and at least partially extending within said at least one internal chamber, said first member being substantially cylindrical in shape and substantially external of said housing, wherein said first and said second members are substantially concentrically aligned.

3. A ported enclosure for an acoustic speaker, comprising:

a substantially cylindrical housing having an exterior portion and having at least one internal chamber, said housing including means for mounting at least one acoustic speaker at least partially within said at least one internal chamber;

a first cylindrical member external to and concentrically aligned with said housing, an annular port being defined between an interior of said first cylindrical member and said exterior portion of said housing extending radially along a height of said housing, said annular port having an annular first cross-sectional area;

a second cylindrical member at least partially within said at least one internal chamber, said second cylindrical member being concentrically aligned with said housing, said cylindrical member defining a cylindrical port within an interior of said second cylindrical member, said cylindrical port having a circular second cross-sectional area;

said housing including a transfer port means for connecting in fluid communication said annular port and said cylindrical port wherein said at least one internal chamber is ported to the exterior of said housing and the exterior of said annular port through said cylindrical and said annular ports;

said first member and said second member cross-sectional areas each being substantially constant, uniform and equal cross sectional areas throughout their lengths.

4. The device of claim 3, wherein said means for connecting in fluid communication said annular port and said cylindrical port includes means for maintaining a constant cross-sectional area between said first and said second cross-sectional areas, wherein said annular port and said cylindrical port maintain substantially equal and constant cross-sectional areas between said at least one internal chamber and the exterior of said housing and said annular port.

5. The device of claim 4, wherein said first cylindrical member extends flush with a first end of said housing.

6. The device of claim 5, wherein said housing includes an inward flare on said first end forming a hemispherical shape at said first end.

7. The device of claim 6, wherein said interior of first cylindrical member flares outward adjacent said first end of said housing.

8. The device of claim 4, wherein said first end of said housing extends longitudinally beyond said first cylindrical member, wherein a second ported enclosure can be stacked the first end of the first ported enclosure to the first end of the second ported enclosure without blocking said annular port.

9. A first ported enclosure for an acoustic speaker, comprising:

a substantially cylindrical housing having an exterior and having a first internal chamber and a second internal chamber, said housing including means for mounting at least one acoustic speaker between said first and said second internal chambers;

a first cylindrical member external to and concentrically aligned with said housing, an annular port being defined between an interior of said first cylindrical member and an exterior portion of said housing extending radially along a height of said housing, said annular port having a first uniform and constant cross-sectional area;

a second cylindrical member at least partially within said first internal chamber, said second cylindrical member being concentrically aligned with said housing, said cylindrical member defining a cylindrical port within an interior of said second cylindrical member, said cylindrical port having a second uniform and constant cross-sectional area;

means for connecting in fluid communication said annular port and said cylindrical port, said first internal chamber being ported to the exterior of said housing and the exterior of said annular port through said cylindrical and said annular ports; and said first and said second cross-sectional areas each having substantially uniform, constant and equal cross-sectional areas throughout their lengths.

10. The device of claim 9, wherein said means for connecting in fluid communication said annular port and said cylindrical port includes means for maintaining a constant cross-sectional area between said first and said second cross-sectional areas, wherein said annular port and said cylindrical port maintain substantially equal and constant cross-sectional areas between said first internal chamber and the exterior of said housing and said annular port.

11. The device of claim 10, wherein said first cylindrical member extends flush with a first end of said housing.

12. The device of claim 11, wherein said housing includes an inward flare on said first end forming a hemispherical shape at said first end.

13. The device of claim 12, wherein said interior of first cylindrical member flares outward adjacent said first end of said housing.

14. The device of claim 10, wherein: said first end of said housing extends longitudinally beyond said first cylindrical member, permitting a second ported enclosure substantially identical to said claimed first ported enclosure to be stacked first end of said first ported enclosure to said first end of said second ported enclosure without blocking said first ported enclosure annular port.

15. A ported enclosure for an acoustic speaker, comprising:

a housing having an exterior and having at least one internal chamber, said housing including means for mounting at least one acoustic speaker at least partially within said at least one internal chamber;

a port having a uniform and constant cross sectional area and connecting in fluid communication said at least one internal chamber with an exterior of said housing, said port having a first member being substantially polygonal in cross-section and having a uniform constant cross sectional area, said first member being adjacent the exterior of said housing;

said port includes a second member being substantially polygonal in cross-section and having a uniform constant cross sectional area, said second member being adjacent said at least one internal chamber; and said port including a third member between said first and said second members, said third member including means for transferring said second member polygonal cross-section area to said first member polygonal cross-section area, and said first member, said second member, and said third member each have a substantially uniform, constant and equal cross-sectional areas throughout their lengths.

* * * * *